US005548859A

United States Patent [19]

Oberg et al.

[11] Patent Number: 5,548,859

[45] Date of Patent: Aug. 27, 1996

[54] METHOD AND APPARATUS FOR PREVENTING SOILED CLOTHES FROM BECOMING PERMANENTLY STAINED

[76] Inventors: Lorri Oberg, 3417 Ione Dr., Los Angeles, Calif. 90068; Pamela R. Weiss, 24943 Kit Carson Rd., Hidden Hills, Calif. 91302

[21] Appl. No.: 454,544

[22] Filed: May 30, 1995

[51] Int. Cl.[6] ..... D06B 19/00; B65D 81/32

[52] U.S. Cl. ..... 8/150; 8/158; 68/213; 206/213

[58] Field of Search ..... 8/150, 158; 68/196, 68/213; 252/92, 93; 206/205, 213, 219, 221, 278

[56] References Cited

U.S. PATENT DOCUMENTS

| | | | |
|---|---|---|---|
| 2,060,238 | 11/1936 | Nilson | 68/213 X |
| 2,342,406 | 2/1944 | Latta et al. | 206/213 X |
| 3,559,317 | 2/1971 | Knight et al. | 68/213 X |
| 3,601,252 | 8/1971 | Sager . | |
| 3,638,786 | 2/1972 | Borecki et al. . | |
| 3,702,677 | 11/1972 | Heffington | 206/205 X |
| 4,362,241 | 12/1982 | Williams | 206/210 |
| 4,537,308 | 8/1985 | Hollander, Jr. | 206/484 |
| 4,691,372 | 9/1987 | Van Erden | 383/63 |
| 5,078,301 | 1/1992 | Gladfelter et al. | 252/93 X |
| 5,161,680 | 11/1992 | Badgley | 206/205 X |
| 5,346,068 | 9/1994 | Gouge et al. | 206/205 X |

FOREIGN PATENT DOCUMENTS

| | | | |
|---|---|---|---|
| 226572 | 9/1989 | Japan . | |
| 52602 | 1/1987 | Poland . | |
| 444237 | 3/1936 | United Kingdom | 68/213 |
| 460424 | 1/1937 | United Kingdom | 68/213 |

*Primary Examiner*—Philip R. Coe

*Attorney, Agent, or Firm*—Laff, Whitesel, Conte & Saret, Ltd.

[57] ABSTRACT

An apparatus for saving soiled clothes from being permanently stained is disclosed. The apparatus includes a resealable bag having an inside portion and an outside portion. A rupturable container is fastened to the inside portion of the resealable bag, and a stain-removing solution is contained inside the rupturable container. The soiled clothes are placed inside the resealable bag, the resealable bag is sealed, and the rupturable container is manually ruptured through the bag. This releases the stain-removing solution onto the soiled clothes, thereby preventing the clothes from being permanently stained.

7 Claims, 2 Drawing Sheets

METHOD AND APPARATUS FOR PREVENTING SOILED CLOTHES FROM BECOMING PERMANENTLY STAINED

FIELD OF THE INVENTION

The present invention relates to a flexible container with a capsule fastened to the inside of the flexible container. More particularly, the invention relates to an apparatus capable of saving soiled clothes from being permanently stained.

BACKGROUND OF THE INVENTION

Clothes can be easily stained from food, drink, oils or the like. In the past, soiled clothes were permanently stained unless they were immediately washed. There are now a number of commercial detergents and stain-removing formulas capable of removing stains from soiled clothes. However, it is not always practical to immediately wash clothes. When traveling away from home, it is even more impractical to immediately wash soiled clothes. In addition, if soiled clothes are not immediately washed, garments which come into contact with the soiled clothes will also be permanently stained.

Thus, one of the objects of the present invention is to provide an apparatus capable of handling soiled clothes until they are washed.

Another object of the present invention is to provide an apparatus capable of removing stains from soiled clothes.

Another object of the present invention is to provide an apparatus capable of preventing soiled clothes from becoming permanently stained.

SUMMARY OF INVENTION

In accordance with the present invention, an apparatus for saving soiled clothes from being permanently stained is disclosed.

The apparatus includes a resealable flexible container having an inside portion and an outside portion. In addition, a rupturable container is fastened to the inside portion of the resealable flexible container.

In one embodiment, the resealable flexible container is a plastic bag which is resealable and waterproof. A rupturable container is fastened to the inside portion of the plastic bag. A stain-removing solution is disposed within the rupturable container. In this embodiment, the soiled clothes are placed inside the plastic bag, and the plastic bag is sealed. The rupturable container is then manually ruptured, thereby releasing the stain-removing solution onto the soiled clothes.

In another embodiment, the rupturable container is not fastened to the inside portion of the resealable flexible container. In this embodiment, the rupturable container is allowed to move freely within the resealable flexible container.

A method of saving soiled clothes from being permanently stained can also be utilized. The soiled clothes are placed in a resealable flexible container. The resealable flexible container is sealed. The rupturable container containing a stain-removing solution is ruptured. Thus, the stain-removing formula is released onto the soiled clothes, thereby saving the soiled clothes from being permanently stained.

In still another embodiment, the rupturable container contains a presoak formula instead of a stain-removing formula.

In another embodiment, the rupturable container is merely a capsule.

In a further embodiment, the rupturable container includes a capsule surrounded by a first outer cover.

In still another embodiment, the rupturable container includes a second outer cover which encloses the capsule surrounded by the first outer cover.

The foregoing features and advantages of the present invention will be apparent from the following more particular description of the invention. The accompanying drawings, listed hereinbelow, are useful in explaining the invention.

BRIEF DESCRIPTION OF THE DRAWINGS

In the text which follows, the invention is explained with reference to illustrative embodiments, in which.

DETAILED DESCRIPTION OF THE INVENTION

For a better understanding of the invention reference may be had to the following detailed description taken in conjunction with the accompanying drawings. Each reference number is consistent throughout all of the drawings.

Figure 1:
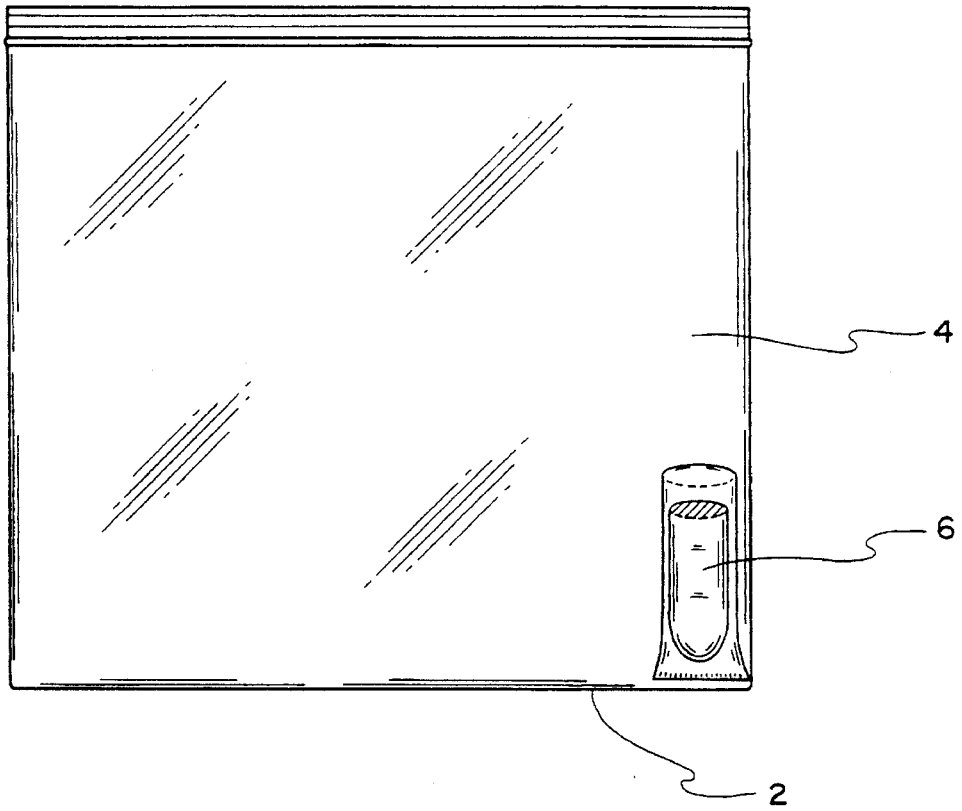
FIG. 1 shows a plan view of the preferred embodiment of the invention.

In FIG. 1, a plan view of the preferred embodiment of the invention is shown. A resealable bag 2 is used to hold the soiled clothes. The resealable bag 2 is made out of clear plastic 4 and is approximately eleven inches in height by ten and a half inches in width. Although a resealable bag is used in the preferred embodiment, any suitable container which is resealable, flexible, and waterproof, could be utilized. In addition, the resealable bag 2 need not be clear; however, a clear bag is preferred.

A rupturable container 6 is attached to the inside portion of the resealable bag 2 by an adhesive (not shown). Any type of adhesive could be used. Alternatively, the rupturable container 6 could simply be placed inside the resealable bag 2 without an adhesive. In this embodiment, the rupturable container 6 is allowed to freely move within the resealable bag 2. The rupturable container 6 is described more fully in the following paragraphs.

Figure 2:
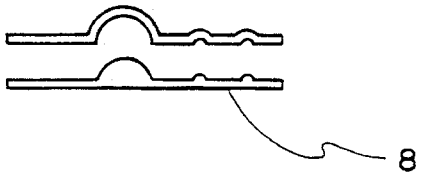
FIG. 2 shows a cross-sectional view of the resealable connection of the preferred embodiment.

In FIG. 2, a cross-sectional view of the resealable connection 8 of the preferred embodiment is shown. In the preferred embodiment, a zip-lock type resealable mechanism 8 is used to seal the soiled clothes inside the resealable bag 2. However, any suitable sealing mechanism could be utilized.

Figure 3:
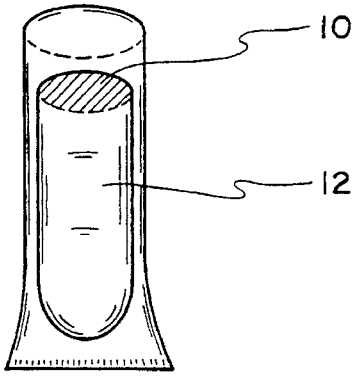
FIG. 3 shows a plan view of the preferred embodiment of the rupturable container.
Figure 4:
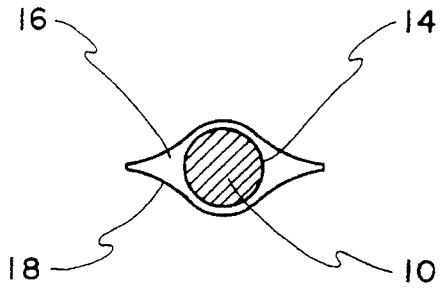
FIG. 4 shows a cross-sectional view of the preferred embodiment of the rupturable container.

FIG. 3 and FIG. 4 show plan and cross-sectional views of the preferred embodiment of the rupturable container 6. In the preferred embodiment, the rupturable container is similar to the bottom half of a medical culture tube used by physicians. One suitable tube is sold under the model number C8852-1A, and is distributed by Baxter Diagnostics, Inc. In the preferred embodiment, the rupturable container 6 is approximately 4 inches in length and approximately 1 inch in circumference. However, a manually rupturable container of any shape or size could be utilized.

In the preferred embodiment, a capsule 10 is disposed within the rupturable container 6. The capsule 10 contains a stain-removing solution 12. In the preferred embodiment, the stain-removing solution 12 is the commercially available detergent "Shout". However, any stain-removing solution could be utilized. Ten cubic centimeters of the stain-removing solution 12 are used in this embodiment, but other quantities could also be used, depending on the bag size and quantity and material composition of the clothes.

A hard plastic inner container wall 14 surrounds the capsule 10. This hard plastic inner container wall 14 prevents the stain-removing solution 12 from leaking out of the capsule 10. Preferably, a hard plastic outer container wall 18 encloses the hard plastic inner container wall 14. This hard plastic outer container wall 18 prevents the hard plastic inner container wall 14 from being accidentally ruptured. A pocket of air 16 may also be present between the hard plastic inner container wall 14 and the hard plastic outer container wall 18.

Figure 5:
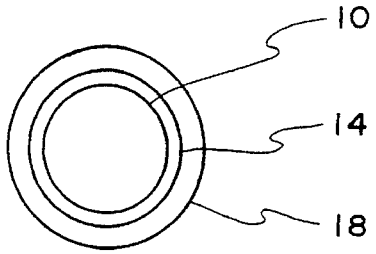
FIG. 5 shows an enlarged cross-sectional view of the rupturable container.

In FIG. 5, an enlarged cross-sectional view of one embodiment of the rupturable container is shown. The capsule 10 is surrounded by the hard plastic inner container wall 14, and the hard plastic inner container wall 14 is surrounded by the hard plastic outer container wall 18. Thus, this enlarged view shows the relationship between the capsule 10, the hard plastic inner container wall 14, and the hard plastic outer wall 18.

Figure 6:
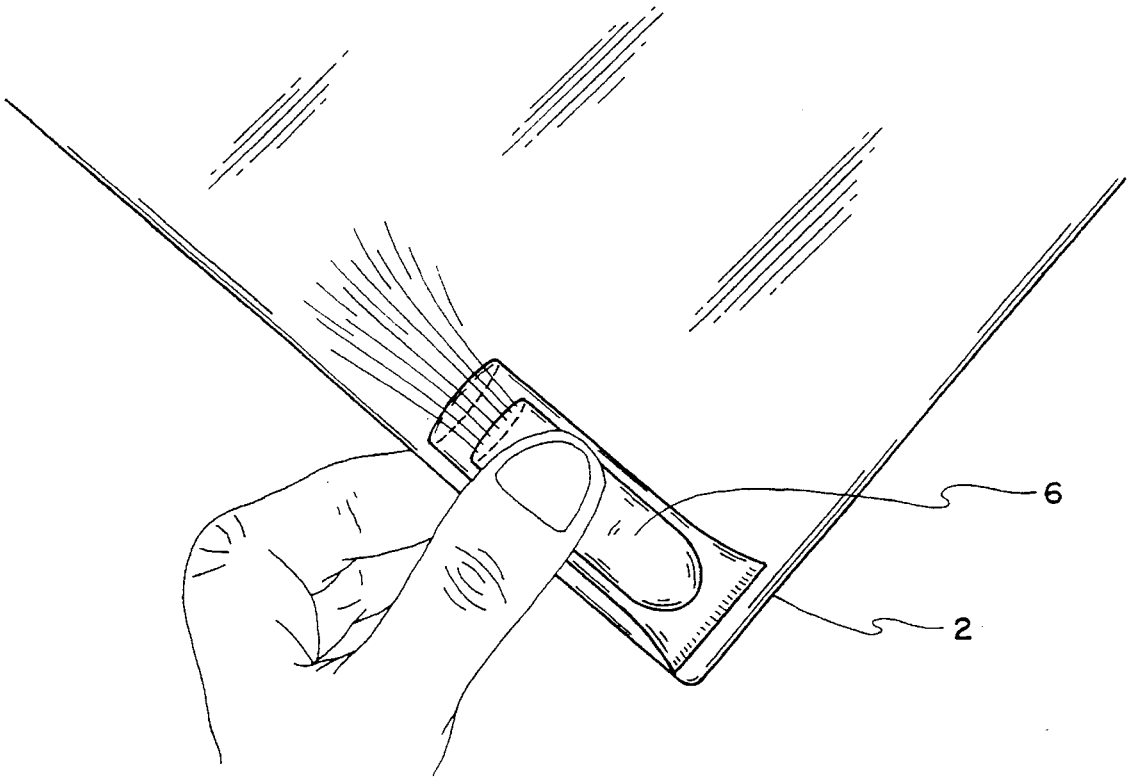
FIG. 6 shows a plan view of the preferred embodiment of the invention being manually activated.

As shown in FIG. 6, soiled clothes are placed inside the resealable bag 2. The bag 2 is sealed. Next, a user applies sufficient pressure to the rupturable container within the bag using her fingertips to rupture the rupturable container, thereby releasing the stain-removing solution from the rupturable container. Thus, the soiled clothes soak in the stain-removing solution until the clothes are removed for washing.

It will be apparent to those skilled in the art, that a person understanding this invention may conceive of changes or other embodiments or variations, which utilize the principles of this invention. All are considered within the sphere, spirit, and scope of the invention. Accordingly, it is not intended that the invention be limited except as may be necessary in view of the appended claims.

What is claimed is:

1. An apparatus for saving soiled clothes from being permanently stained comprising:

a) a resealable flexible container suitable for holding clothing articles; and b) a rupturable container within the resealable flexible container, wherein the rupturable container contains a presoak formula.

2. The apparatus of claim 1 wherein the presoak formula is a stain-removing solution.

3. The apparatus of claim 2 wherein the resealable flexible container is plastic bag.

4. The apparatus of claim 3 wherein the rupturable container is plastic.

5. An apparatus for saving soiled clothes from being permanently stained comprising:

a) a resealable waterproof bag having an inside portion and an outside portion;

b) a rupturable container fastened to the inside portion; and c) a stain-removing solution disposed inside the rupturable container, whereby soiled clothes inside the resealable waterproof bag are exposed to the stain-removing solution upon rupturing the rupturable container.

6. The apparatus of claim 5 wherein the rupturable container comprises:

a) a capsule retaining the stain-removing solution;

b) a first plastic cover surrounding the capsule; and c) a second plastic cover surrounding the first plastic cover.

7. A method of saving soiled clothes from being permanently stained, the method comprising the steps of:

a) placing the soiled clothes in a resealable flexible container having stain-removing solution inside a sealed but rupturable container disposed within the flexible container;

b) sealing the resealable flexible container; and c) rupturing the rupturable container to release the stain-removing solution onto the soiled clothes.

* * * * *